US005941802A

United States Patent [19]

Kiser

[11] Patent Number: 5,941,802

[45] Date of Patent: Aug. 24, 1999

[54] PULL-UP ASSISTANT

[75] Inventor: James G. Kiser, Harrisonburg, Va.

[73] Assignee: Sportime L.L.C., Atlanta, Ga.

[21] Appl. No.: 09/063,359

[22] Filed: Apr. 21, 1998

Related U.S. Application Data

[60] Provisional application No. 60/043,965, Apr. 22, 1997.

[51] Int. Cl.[6] ..... A63B 22/10

[52] U.S. Cl. ..... 482/92; 482/38; 482/129

[58] Field of Search ..... 482/24, 26, 38–40, 482/43, 66, 69, 77, 121–124, 129, 130, 143, 92; 472/118, 135; 297/273–275

[56] References Cited

U.S. PATENT DOCUMENTS

| | | | |
|---|---|---|---|
| 140,237 | 6/1873 | Austin | 482/124 |
| 3,701,529 | 10/1972 | Kruthaupt | 482/38 X |
| 3,707,285 | 12/1972 | Martin | 482/38 |
| 3,726,521 | 4/1973 | Sidlauskas | 297/274 X |
| 5,125,649 | 6/1992 | Fuller | 482/123 |
| 5,284,459 | 2/1994 | Podd | 482/51 |

FOREIGN PATENT DOCUMENTS

| | | | |
|---|---|---|---|
| 158684 | 2/1905 | Germany | 402/40 |

*Primary Examiner*—John Mulcahy
*Attorney, Agent, or Firm*—Browdy and Neimark

[57] ABSTRACT

An apparatus for assisting in performing pull-ups under an overhead bar (B) provides an adjustable upward force on a foot holder (2) to decrease the effort needed for pulling up the body. The force is adjusted by varying the number of bungee-cord linear springs (3) between the bar and the foot holder. The holder has a platform (22) and a shoe strap (11) to hold just one of the user's feet; the other foot is wrapped around the other leg. Looped ends of the bungee cords, formed by clamps (4), are attached with rings (14) or carabiners (6) to the platform and to straps (7) looped around the bar. A safety strap (1) holds the foot holder stable.

13 Claims, 3 Drawing Sheets

PULL-UP ASSISTANT

CROSS-REFERENCE TO RELATED APPLICATION

This application claims the benefit of provisional application Ser. No. 60/043,965, filed Apr. 22, 1997.

FIELD OF THE INVENTION

The present invention relates to exercise and exercise equipment, more particularly to apparatus for performing pull-up exercises.

REVIEW OF THE RELATED TECHNOLOGY

Pull-ups are exercises in which a person grasps a bar and pulls his or her body upward against the force of gravity toward the bar. This exercise is a difficult one and many children, especially obese children, cannot perform it satisfactorily. This problem has been dealt with by arranging for pull-ups in a direction other than true vertical, e.g. with the body moving in a horizontal or slanted direction so that the force required for a pull-up is less than the person's true weight.

Such inclined exercises require much more floor area than true vertical pull-ups and demand expensive, bulky body supports.

Another drawback is that varying the pull-up force requires adjusting the position of a large and bulky piece of gear, which will be difficult unless the apparatus is carefully designed and in good working order.

SUMMARY OF THE INVENTION

Accordingly, the present invention has as an object, among others, to overcome deficiencies in the prior art such as noted above.

The present invention provides a variable-resistance, mobile, easy-to-use piece of fitness equipment designed to aid students in developing upper body strength and, more specifically, in performing pull-ups. The invention permits the force to be varied quite easily while the user stays in place, permitting quick adjustment for individual users. It is inexpensive but rugged.

The invention includes an apparatus to be used with a conventional pull-up bar that is positioned horizontally overhead. The apparatus includes a base platform or "shoe" with one or more bungee cords attached to each side of the shoe and the bar. The bungee cords may be added or removed from the shoe (and optionally the overhead bar) individually, to vary the resistance in increments. Eye bolts with loops at the end of the shoe, and quick links, for example, constitute appropriate hardware for attaching and removing bungee cords. ("quick link" herein refers to a closed-loop element which can be opened to admit an element and then locked closed. It typically comprises a sliding barrel with a screw thread that bridges the gap in the loop.)

In one preferred embodiment, the cords are 34 inches long. At the top, they are secured together preferably with a 4" D-ring. ("D-ring" herein refers to another type of openable link, common in mountaineering, that uses a resiliently-closed door element. Such a link is also called a "carabiner". However, any type of openable link can be used in the present invention.) Each D-ring clips into a preferably 1"×12" nylon bar strap looped around the overhead pull-up bar. To make the device stable, a 1"×24" nylon adjustable safety strap is attached to the bottom of the shoe. Distal the shoe is a sliding-bolt snap. This safety strap is then attached to a ⅜" eye bolt that is mounted near the shoe, such as on the floor or ground, at the bottom of a wall supporting the pull-up bar, or to a vertical bar supporting the horizontal overhead pull-up bar.

The user stands on a chair or other platform and places one foot into the "shoe". Preferably, this shoe is sufficiently large to comfortably hold the user's entire foot. While stepping into the shoe the user grasps the pull up bar and locks his or her free leg around the front of the shoe. The amount of resistance, as set by the number of attached bungee cords, should enable the user to execute approximately 10 pull-ups. Once the user comfortably performs 10–15 pull-ups, the level of difficulty can be increased by removing one bungee cord from each side of the shoe. One simply releases one cord from each D-ring.

The present invention is motivational because it assists all users in executing pull-ups by supporting their weight. As the user's strength increases he or she can adjust the pull-up assistant to lessen its upward pull.

BRIEF DESCRIPTION OF THE DRAWING

The above and other objects and the nature and dvantages of the present invention will become more apparent from the following detailed description of an embodiment taken in conjunction with drawings, wherein.

DETAILED DESCRIPTION OF THE PREFERRED EMBODIMENT

Figure 1:
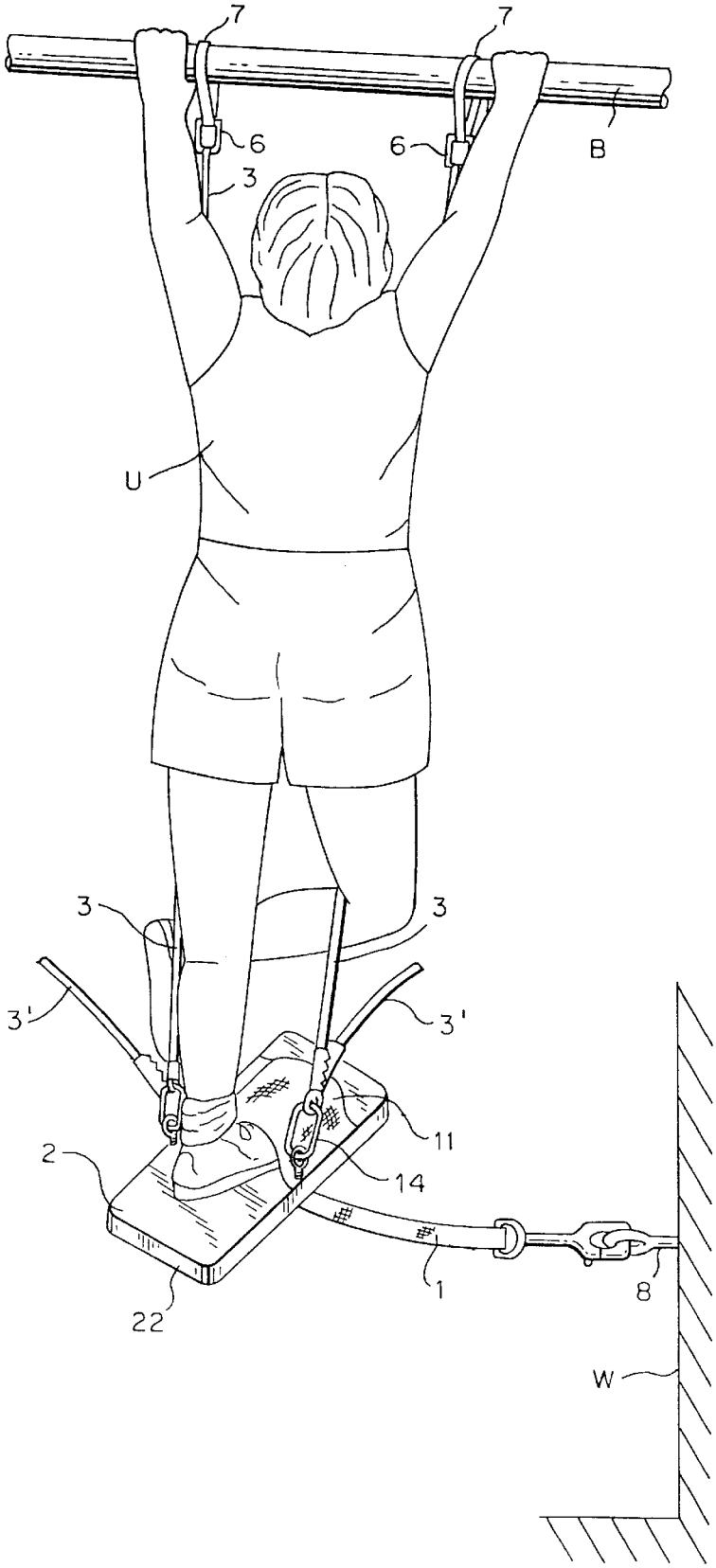
FIG. 1 is a perspective view partial view showing the invention in use.

FIG. 1 depicts the present invention in its preferred method of use. The device of the invention is connected to a fixed wall W (shown schematically in cross section in FIG. 1) or to some other anchor by means of a nylon safety strap 1. Connected to the other end of this safety strap is a shoe 2 including a platform 22, which is preferably a laminated-wood or heavy molded plastic platform, upon which the user places his or her foot. Attached to the shoe 2 at opposite-side locations (for providing balanced support) are bungee cords 3 which support the weight of the user U. The cords 3 are fastened at their upper ends to bar straps 7 which pass around a pull-up bar B. The shoe 2 includes a shoe strap 11 to hold the user's foot in place on the shoe platform 22.

To vary the upward pull-up assisting force a number of bungee cords are provided on each side, e.g. four per side, and these are readily detached from upper D-rings 6, which are preferably a quick-release type. Detached bungee cords 3', depicted in partial view, are shown still attached to lower D-rings 11 in FIG. 1.

The user U may initially stand on a chair or other platform (not shown) and step onto or into the shoe 2, simultaneously grasping the pull up bar B and locking the free leg around the front of the anchored foot and/or shoe 2 as shown in FIG. 1.

Figure 2A:
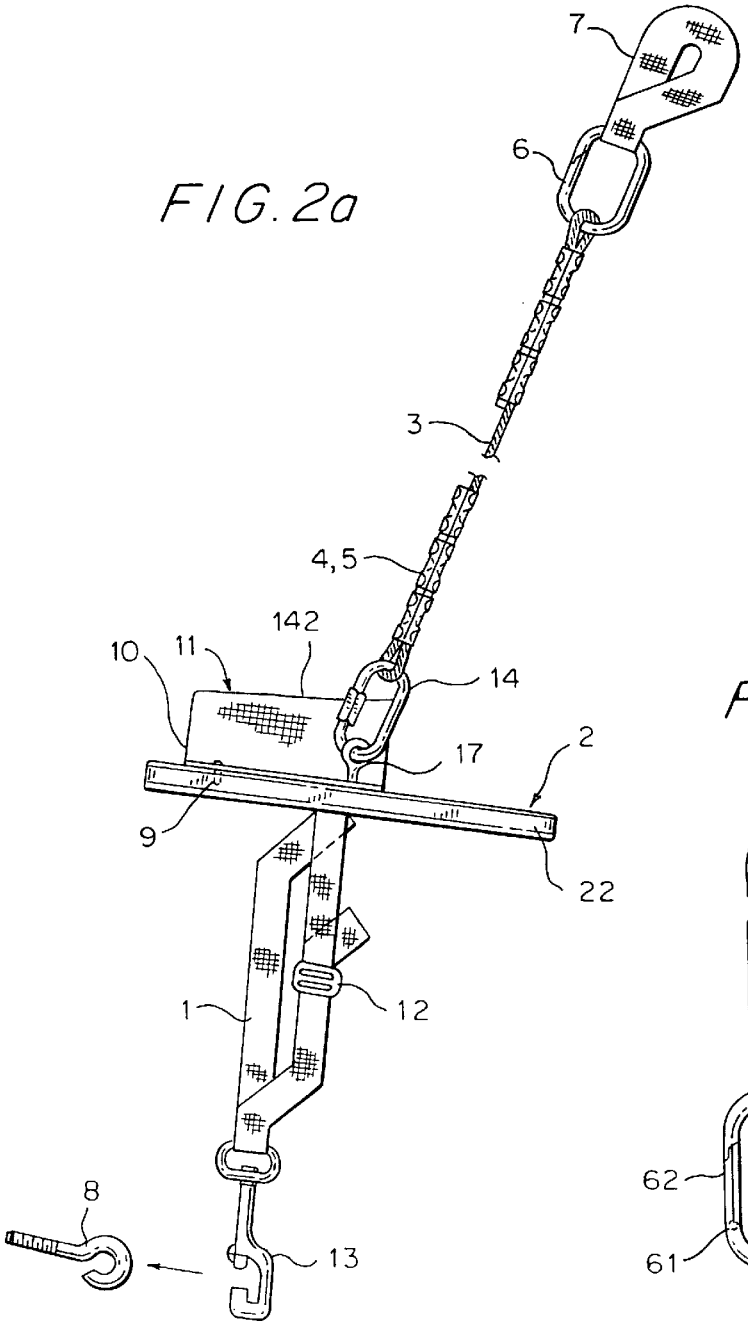
FIG. 2*a* is an elevational side view of the invention.

FIG. 2*a* provides a more detailed view of the present invention. The illustrated features are discussed starting at the top end, which is shown in detail in FIG. 2*b.:*

Each bungee cord 3 is looped at both ends and the loop is secured by Cooper tool rope clamps 4, preferably covered with heat shrink tubing 5. The bungee cords can also include some equivalent conventional means for making a ring or loop at the end of a bungee cord. D-ring 6 secures the bungee cords on each side to the top nylon bar strap 7, which is formed into a noose about the pull-up bar B (best seen in FIG. 3).

Any number of bungee cords 3 may be used, from one up to four or more on either side. Decreasing the number of cords hooked to the pull-up bar lessens the amount of support provided to the user U. The cords preferably measure 34 inches long.

Conventional bungee cord material, which is readily available, is preferred for forming the cords 3 of the invention. Bungee cord consists of numerous parallel rubber cords or strings, each comparable in cross-sectional size to an ordinary rubber band, surrounded by a woven fabric sheath. Because of the many strings which make it up, a bungee cord cannot fail suddenly; if one string breaks the others will still exert force. The parallel strings rub against one another on extension and relaxation and provide bungee cords with good damping qualities. The bungee cords 3 can be replaced by metal-wire coil springs, surgical tubing, or any other linear springy device.

Figure 2B:
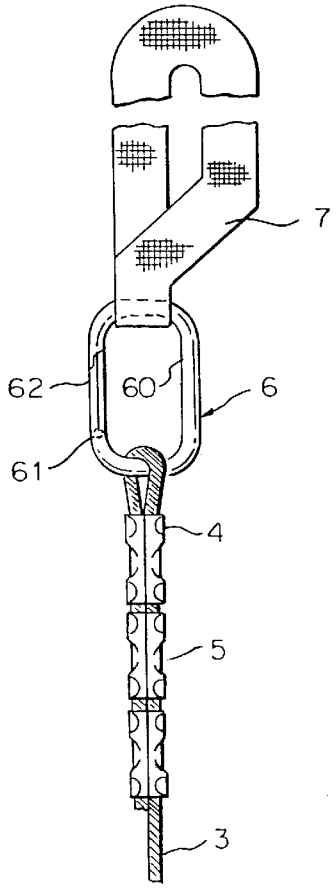
FIG. 2*b* is a detail of FIG. 2*a;*

FIG. 2*b* shows the preferred form of the upper ring 6, a mountaineering-type carabiner which has a C-shaped metal body 60 hinged to a door 62 by a pin 61. The door 62 is spring-loaded into the closed position, in which at tooth the end of the door 62 fits an indentation in the body 60 to add strength. Such a carabiner ring can be opened simply by pressing the door 62 into the central space, and closed by releasing the door 62 to snap back into the indentation. A bungee cord loop can be quickly added or subtracted from a number of bungee cords engaged in the ring 6.

FIG. 2*a* shows the bottom end of the cord 3, where and an eye bolt 17 and a quick link 14 connecting the looped bungee cords 3 to the platform 22 on either side. Cooper tool rope clamps 4, covered with heat shrink or plastic tubing 5, are again used to form loops. The links 14 are preferably of the 3" size and are opened and closed by a barrel 142 which screws onto an end of a C-shaped body. The lower ring or link 14 does not require the same degree of convenience for removing the bungee cord 3 loops as the upper ring G because the full number of cords is left engaged through the lower ring 14 in use.

Figure 3:
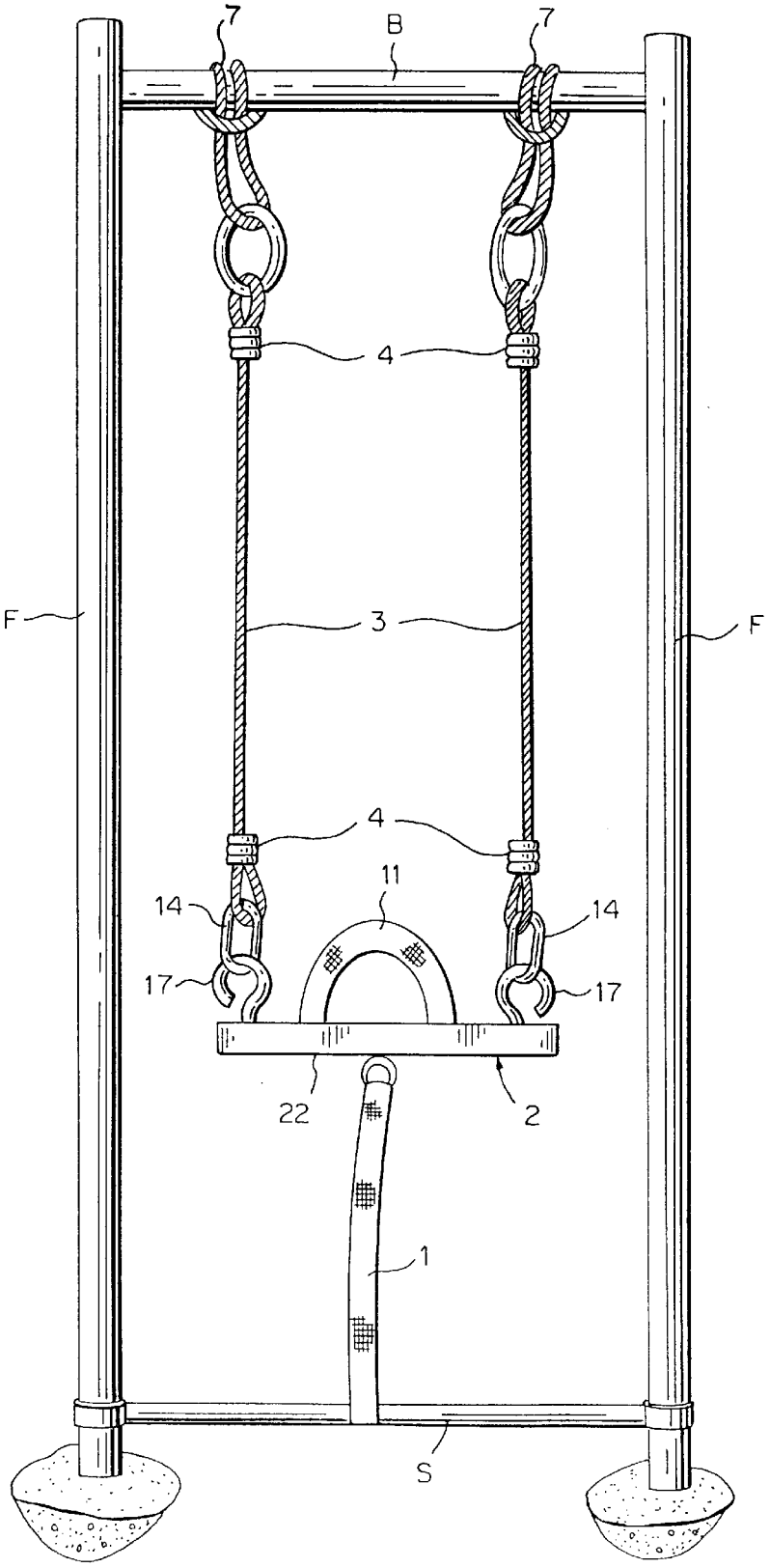
FIG. 3 is an elevational view.

Each lower ring 14 is engaged through an eyebolt 17 fastened into a platform 22 which preferably measures about 7 and ¼"×12". The upper side of the platform 22 acts as a shoe 2 with a shoe strap 11 across the platform 22. This provides the user a secure area in which to place his or her foot on the upper surface of the platform 22 while exercising. The preferred material for the shoe strap 11 is strong woven and coated fabric, e.g. coated nylon, which is inflexible enough that the shoe strap 11 remains arched (as best seen in FIG. 3) but may also be formed with stiffened edges, may be molded of plastic, or be formed by any other conventional material and method. The sides of the shoe strap 11 are fastened to the platform 22 by conventional wood screws 9 and anchor bars 10 passed through fabric tubes sewed into the edges of the shoe strap 11.

Besides the strap 11, any means for holding a foot on the platform (here and in the following claims, any means for holding a foot is comprised in a "foot holder") can be used, including: the preferred shoe strap 11 on the platform 22; a special shoe worn by the user and adapted to stick or clip to a platform; an object with a hollow space for accepting a foot; a pad, shoe, or other device passed over a double-length cord, so that the user can step indirectly onto the cord.

The lower safety strap 1 which attaches the base of the shoe platform 22 to an eye bolt 8 is adjustable in length by a buckle 12 and is mountable in a wall (or some other fixed object not shown) by an eyebolt 8. Instead of the illustrated machine threads, the eyebolt 8 may have penetrating or self-tapping threads like a wood screw or metal screw. The lower safety strap 1 is preferably of nylon or other sufficiently strong flexible material approximately 1" wide and 24" in length. The user may adjust the length by feeding a portion of the nylon through buckle 12. A swivel bolt snap 13 connects the safety strap to a wall-mounted eye bolt 8.

FIG. 3 shows an outdoor version of the invention which includes upright frames F which support the bar B at their upper ends and are fixed at their lower ends, e.g. in concrete as shown schematically. Across the lower ends of the frames F are fastened to them is a strap support S, around which the safety strap 1 is looped.

The use of the invention is as follows:

Students should use the amount of resistance (number of bungee cords) needed to aid them in executing approximately 10 pull-ups. Once a student can easily perform 10 to 15 pull-ups the difficulty can be increased by removing one bungee cord 3 from each side of the shoe 2. To do this the student will simply remove the cords from the D-rings and let them hang from the shoe.

An older child will be able to release cords without assistance, by using one or both hands to open a D-ring and remove one cord loop first on one side, then the other. The present invention contemplates alternative sorts of D-rings, other than carabiners, from which a loop can be easily removed.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention.

Thus the expressions "means to . . . " and "means for . . . " as may be found in the specification above and/or in the claims below, followed by a functional statement, are intended to define and cover whatever structural, physical, chemical or electrical element or structure may now or in the future exist which carries out the recited function, whether or not precisely equivalent to the embodiment or embodiments disclosed in the specification above; and it is intended that such expressions be given their broadest interpretation.

What is claimed is:

1. A pull-up assistant apparatus for use with an overhead bar (B) by a user (U) having a foot and hands, the apparatus comprising:

a foot holder (2) having two opposing sides including a left side and a right side;

a safety strap (1) having one end attached to the foot holder and having an opposite end with an attachment to attach to a static structure;

a plurality of linear springs (3) numbering greater than 2, further comprising a first plurality attachable to the left side, and a second plurality attachable to the right side;

each of the linear springs including a lower attachment device (4, 14) at a respective lower end on the left or the right side of the foot holder;

each of the linear springs including an upper attachment device (4, 6, 7) at a respective upper end thereof, whereby the respective upper end is removably attachable to the bar;

whereby the user's foot may step on the foot holder, the user's hands may grasp the bar, and the linear springs may assist in the user performing a pull-up; an upward force on the foot holder being variable by attaching or removing upper ends of the linear springs.

2. The apparatus according to claim 1, wherein the foot holder comprises a platform (22) and a shoe strap (11), the user's foot being insertable between an upper surface of the platform and the shoe strap.

3. The apparatus according to claim 1, wherein the foot holder includes a platform width between the two opposing sides adapted to hold just one of the user's two feet inserted thereon.

4. The apparatus according to claim 3, wherein the platform width is approximately 7 and ¼ inches.

5. The apparatus according to claim 1, wherein the upper attachment device includes a ring (61) with a spring-closed gate (62).

6. The apparatus according to claim 5, wherein the upper attachment device includes a bar strap (7) for coupling the ring to the bar.

7. The apparatus according to claim 1, wherein the linear springs include a bungee cord.

8. The apparatus according to claim 7, wherein the bungee cord includes a loop at at least one of the upper end and the lower end.

9. The apparatus according to claim 1, wherein the safety strap includes a snap attachment (13) at an end opposite the foot holder.

10. A pull-up assistant apparatus for use with an overhead bar (B) by a user (U) having a foot and hands, the apparatus comprising:

a foot holder (2) having a two opposing sides;

wherein the foot holder includes a platform width between the two opposing sides adapted to hold lust one of the user's two feet inserted thereon;

a safety strap (1) having one end attached to the foot holder and having an opposite end with an attachment to attach to a static structure;

a plurality of linear springs (3) disposable between the bar and the two opposing sides;

variable support tension means for adjusting the springs to vary tension therein;

whereby the user's foot may step on the foot holder, the user's hands may grasp the bar, and the linear springs may assist in the user performing a pull-up; an upward force on the foot holder being variable by the means for adjusting.

11. A pull-up assistant apparatus for use by a user (U) having a foot and hands, the apparatus comprising:

an overhead bar (B);

a foot holder (2) having two opposing sides including a left side and a right side;

a safety strap (1) having one end attached to the foot holder and having an opposite end with an attachment to attach to a static structure;

a plurality of linear springs (3) numbering greater than 2, further comprising a first plurality attachable to the left side, and a second plurality attachable to the right side;

each of the linear springs including a lower attachment device (4, 14) at a respective lower end on the left or the right side of the foot holder;

each of the linear springs including an upper attachment device (4, 6, 7) at a respective upper end thereof, whereby the respective upper end is removably attachable to the bar;

whereby the user's foot may step on the foot holder, the user's hands may grasp the bar, and the linear springs may assist in the user performing a pull-up; an upward force on the foot holder being variable by attaching or removing upper ends of the linear springs.

12. The apparatus according to claim 11, comprising a support frame (F) supporting the bar.

13. The apparatus according to claim 12, wherein the support frame includes a safety strap support (S).

* * * * *